US008141540B2

(12) United States Patent
Wagner et al.

(10) Patent No.: US 8,141,540 B2
(45) Date of Patent: Mar. 27, 2012

(54) METHOD FOR OPERATING AN INTERNAL COMBUSTION ENGINE

(75) Inventors: Horst Wagner, Stuttgart (DE); Michael Kessler, Weissach (DE); Simon Wunderlin, Stuttgart (DE); Jens Damitz, Illingen (DE); Thomas Bossmeyer, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 553 days.

(21) Appl. No.: 12/300,744

(22) PCT Filed: May 4, 2007

(86) PCT No.: PCT/EP2007/054331

§ 371 (c)(1),
(2), (4) Date: Apr. 16, 2009

(87) PCT Pub. No.: WO2007/141096

PCT Pub. Date: Dec. 13, 2007

(65) Prior Publication Data

US 2009/0320787 A1 Dec. 31, 2009

(30) Foreign Application Priority Data

Jun. 8, 2006 (DE) ..... 10 2006 026 640

(51) Int. Cl.
*F02D 41/14* (2006.01)

(52) U.S. Cl. ..... 123/436; 123/673

(58) Field of Classification Search ..... 123/436, 123/673

See application file for complete search history.

(56) References Cited

U.S. PATENT DOCUMENTS

| | | | | |
|---|---|---|---|---|
| 4,688,535 | A | 8/1987 | Kuettner et al. | |
| 4,883,038 | A * | 11/1989 | Nakaniwa | 123/436 |
| 5,069,183 | A | 12/1991 | Nagano et al. | |
| 5,117,793 | A * | 6/1992 | Taue et al. | 123/436 |
| 5,131,371 | A * | 7/1992 | Wahl et al. | 123/436 |
| 5,638,278 | A * | 6/1997 | Nishimura et al. | 701/111 |
| 5,862,505 | A * | 1/1999 | Fujiki | 701/111 |
| 6,267,101 | B1 | 7/2001 | Kim | |
| 6,286,482 | B1 * | 9/2001 | Flynn et al. | 123/435 |
| 7,231,289 | B2 | 6/2007 | Damitz et al. | |
| 7,455,048 | B2 * | 11/2008 | Maier-Landgrebe | 123/436 |
| 7,778,762 | B2 * | 8/2010 | Loeffler et al. | 701/103 |

FOREIGN PATENT DOCUMENTS

| | | |
|---|---|---|
| DE | 19527218 | 6/1996 |
| DE | 102004/046082 | 3/2006 |
| DE | 102004/046083 | 3/2006 |
| EP | 0364959 | 4/1990 |
| JP | 9-151772 | 6/1997 |
| JP | 2000-73839 | 3/2000 |
| JP | 2001-82224 | 3/2001 |
| JP | 2002-210540 | 7/2002 |
| JP | 2006-46252 | 2/2006 |

OTHER PUBLICATIONS

International Search Report, PCT International Patent Application No. PCT/EP2007/054331, dated Jul. 24, 2007.

* cited by examiner

*Primary Examiner* — Erick Solis
(74) *Attorney, Agent, or Firm* — Kenyon & Kenyon LLP

(57) ABSTRACT

In an internal combustion engine, at least one rotation variable characterizing the rotational movement of a crankshaft is ascertained cylinder-specifically. It is provided that, in an operating state in which differences and/or fluctuations of the rotation variable are basically a function of a combustion position, the instant of a fuel injection is adapted cylinder-specifically in order to reduce the differences and or fluctuations.

9 Claims, 3 Drawing Sheets

METHOD FOR OPERATING AN INTERNAL COMBUSTION ENGINE

FIELD OF THE INVENTION

The present invention relates to a method for operating an internal combustion engine.

BACKGROUND INFORMATION

German Patent Application No. DE 195 27 218 A1 describes a quantity-compensation control. In that case, disparities in the fuel quantity injected into the individual cylinders are inferred from irregularities of the crankshaft rotation, thus, from the extent of the cylinder-specific rotational accelerations within one working cycle. This is based on the following consideration: The heat released during a combustion in the combustion chamber is converted into mechanical work upon expansion of the gas in the cylinder, and accelerates the crankshaft. Ideally, the torque shares of all cylinders of an engine are identical. In reality, however, this is not the case. Differences in the torque shares give rise to differences in the acceleration of the crankshaft, which can be recorded by a speed sensor. In many operating situations, different torque shares are caused by different injection quantities, and can be offset by a cylinder-specific correction of the injection quantity when working with the quantity-compensation control described at the outset.

Moreover, German Patent Application No. DE 10 2004 046 083 A1 describes a method in which a sensor is disposed at a guide cylinder, by which a feature characterizing the combustion can be obtained for this guide cylinder. The other cylinders are adapted to this guide cylinder with the aid of a compensation functionality. This method is advantageous primarily for those combustion processes which have a great ignition lag, e.g., what are referred to as partial homogeneous combustion processes.

SUMMARY

An object of the present invention is to further develop a method of the type described above in such a way that it allows an operation of the internal combustion engine that is quiet and optimal from the standpoint of fuel consumption and emissions in as many operating states as possible, without great expenditure.

According to an example embodiment of the present invention, it was recognized that, particularly in the case of a diesel internal combustion engine, differences and/or fluctuations of a rotation variable characterizing the rotational movement of a crankshaft have different causes depending on the operating state. In this connection, a "difference" of the rotation variable is understood to mean that the rotation variable differs from one cylinder to another, thus "locally." The term "fluctuation" of the rotation variable, on the other hand, means the rotation variable of the same cylinder varies over time. In this context, the rotation variable is usually a rotational acceleration of the crankshaft recorded cylinder-specifically and for a plurality of instants within one working cycle and/or a rotational speed of the crankshaft recorded cylinder-specifically and for one working cycle.

According to an example embodiment of the present invention, there is at least one operating state in which differences and/or fluctuations of the rotation variable are generally a function of a combustion position. Frequently the start of combustion or a center-of-gravity location of the heat conversion, expressed in degrees crank angle, is used as measure for the combustion position. In such an operating state, the combustion position may be optimized in such a way that the specified differences and/or fluctuations are reduced, thereby improving comfort during the operation of the internal combustion engine and optimizing the emissions and fuel consumption of the internal combustion engine. A typical operating state in which differences and or fluctuations of the rotation variable are generally a function of a combustion position is an operating mode having partial homogeneous mixture formation and/or a regeneration operating mode for an exhaust-gas treatment device. This is based on the following considerations:

Above all in the case of diesel internal combustion engines, "partial homogeneous" combustion processes, for which high exhaust-gas recirculation rates are characteristic, have been developed in order to satisfy the steadily rising standards with respect to fuel consumption, exhaust-gas emissions, noise and riding comfort—in the case of installation in a motor vehicle. These combustion processes are called "partial homogeneous" because, in contrast to conventional combustion processes, they feature a greater intermixture and homogenization of the cylinder charge. It may be that operation of the internal combustion engine with such a "non-conventional" combustion process is not possible in the entire speed range and load range, but is possible in a relatively large range relevant with respect to emissions.

However, high exhaust-gas recirculation rates increase the ignition lag up to values which lead to delayed combustions. Under unfavorable conditions, misfirings even occur. Cyclical fluctuations of the cylinder charge and of the combustion procedure make themselves felt considerably more strongly in these "non-conventional" combustion processes than in conventional combustion processes. The reasons for such fluctuations are, first of all, transient events, e.g., upon changes of load or speed; secondly, differences exist between the individual cylinders of an internal combustion engine, for example, with respect to compression, temperature, dimensions of the intake port, etc. Because of the increased sensitivity with respect to such cyclical fluctuations during operation with high exhaust-gas recirculation rate, these differences between the individual cylinders exert a considerable influence on the ignition lag and combustion position.

Thanks to the example method according to the present invention, by adapting the instant of the fuel injection and/or a fresh-air volume and/or an exhaust-gas recirculation rate, it is possible to influence the ignition lag and therefore also the combustion position, and thereby to reduce the specified differences and/or fluctuations of the rotation variable. This is possible without a pressure measurement in a guide cylinder or the complex evaluation of a structure-borne noise signal, which means the costs in the practical application of the example method according to the present invention are low. The expense for the calculation of a heat-release development may also be omitted. Instead, the rotation variable, available in any case, is evaluated accordingly.

In this context, it is particularly advantageous if, initially in a first step, in an initial operating state in which the differences or fluctuations of the rotation variable are basically not a function of the combustion position, an injected fuel quantity is adapted cylinder-specifically along the lines of a quantity-compensation control, in order to reduce the differences or fluctuations. This is based on the knowledge that differences and fluctuations of the combustion position can be disregarded in conventional operation of the internal combustion engine. In such an initial operating state, differences in the rotation variable are attributable primarily to differences in the injection mass. Therefore, initially the quantity-compensation control necessary because of injector tolerances may be carried out in such an operating mode, and then the combustion position may be optimized at least indirectly in the operating state described above. In this context, in that operating state in which differences and/or fluctuations of the rotation variables are basically a function of a combustion position, the correction values ascertained beforehand by the quantity-compensation control are used unaltered. In this way, a particularly uniform operation, optimal from the standpoint of emissions and fuel, becomes possible.

At the same time, based on the cylinder-specific rotation variable, it is possible to ascertain a cylinder-specific combustion position or a cylinder-specific torque as an absolute value. It contains additional information which may be used for the open-loop and closed-loop control of the internal combustion engine.

In further refinement, to that end, it is provided to use a torque, a torque derived from a cylinder pressure in a guide cylinder, a torque ascertained from a lambda value and an air charge, or a torque ascertained from the rotation variable as a reference quantity for the absolute value.

The instant of the fuel injection and/or the fresh-air volume and/or the exhaust-gas recirculation rate may be adapted by correcting the cylinder-specific combustion position or the cylinder-specific torque to a setpoint value. This may be implemented by programming.

In this context, the combustion position may be adjusted to a temporal and/or local average value by, for example, supplying the difference between a cylinder-specific actual rotation variable and an actual rotation variable averaged over the cylinders directly to a controller.

BRIEF DESCRIPTION OF THE DRAWINGS

Preferred specific embodiments of the present invention are explained in greater detail below with reference to the accompanying figures.

DETAILED DESCRIPTION OF EXAMPLE EMBODIMENTS

Figure 1:
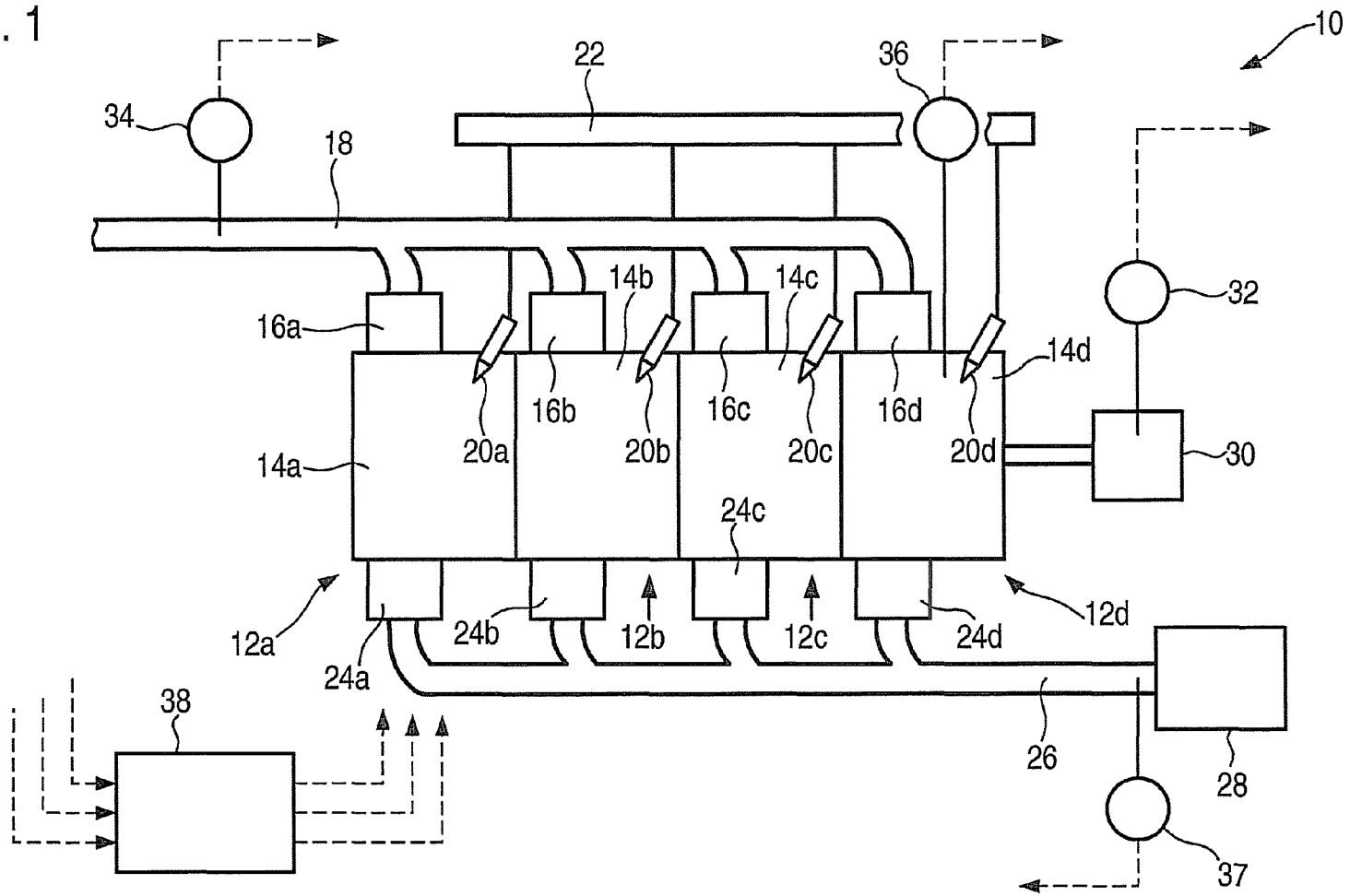
FIG. 1 shows a schematic representation of an internal combustion engine having a plurality of cylinders.

In FIG. 1, an internal combustion engine is designated overall by reference numeral 10. In the case at hand, it includes a total of four cylinders 12*a*, 12*b*, 12*c* and 12*d*. They in turn are provided with combustion chambers 14*a* through *d*, into which fresh air arrives via an intake valve 16*a* through *d* and an intake manifold 18. Fuel is injected into combustion chambers 14*a* through *d* through injectors 20*a* through *d*, which are connected to a shared high-pressure fuel accumulator 22, also known as a "rail."

Combustion exhaust gases are conducted out of combustion chambers 14*a* through *d* with the aid of exhaust valves 24*a* through *d* into an exhaust pipe 26 to an exhaust-gas treatment device 28. During operation of internal combustion engine 10, a crankshaft 30 is set into rotation whose speed, i.e., rotational speed and rotational acceleration (="rotation variables"), is recorded by a crankshaft sensor 32 having extremely high time resolution. A fresh-air mass flowing via intake manifold 18 to combustion chambers 14*a* through *d* is measured by a HFM sensor (hot-film air-mass meter) 34. Also disposed at internal combustion engine 10 is a combustion-chamber pressure sensor 36 which records the pressure in combustion chamber 14*d*. In this respect, corresponding cylinder 12*d* is a "guide cylinder." A lambda sensor 37 is situated upstream of exhaust-gas treatment device 28. Internal combustion engine 10 is able to be operated with exhaust-gas recirculation. To that end, either an exhaust-gas recirculation valve (not shown in the drawing) may be provided (external exhaust-gas recirculation), or it is possible to work with an internal exhaust-gas recirculation by suitable valve-opening times.

The operation of internal combustion engine 10 is controlled and regulated by a control and regulating device 38. It receives signals, inter-alia, from crankshaft sensor 32, HFM sensor 34 and combustion-chamber pressure sensor 36. Among other things, injectors 20 are driven by control and regulating device 38. At this juncture, it should be pointed out that when the index a through d is not mentioned in the case of a component, the corresponding remarks hold true for all components a through d.

Figure 2:
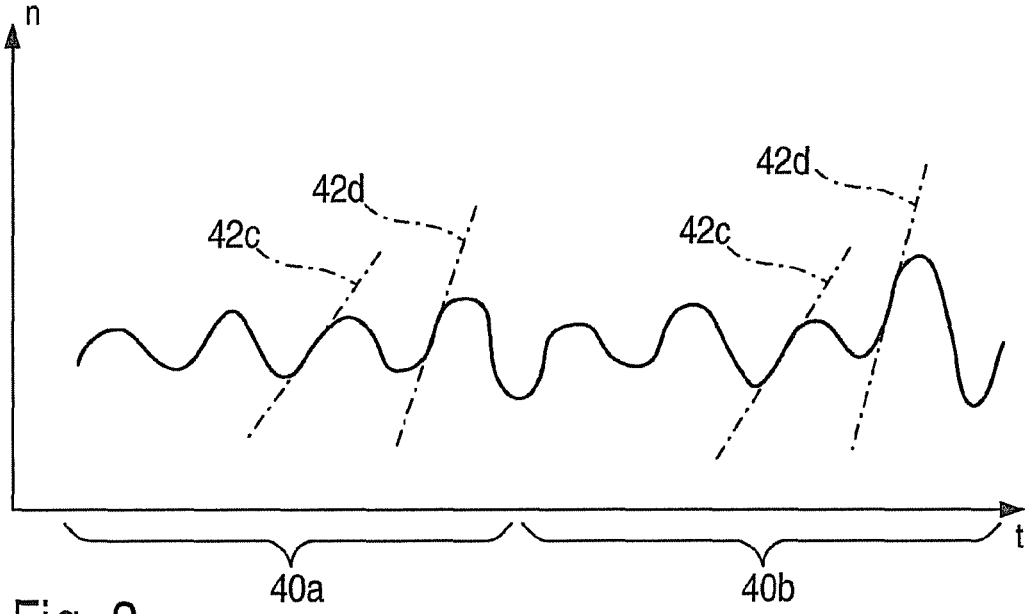
FIG. 2 shows a diagram in which a temporally highly-resolved signal of a speed sensor of the internal combustion engine from FIG. 1 is plotted against time.

In FIG. 2, the temporally highly-resolved signal n (speed or rotational speed) of crankshaft sensor 32 is plotted against time t. One can see that, even in the case of a "globally" constant speed n, speed n considered "microscopically," thus highly resolved in time, varies cyclically. This is attributable to the individual combustions in individual cylinders 12, which in each case result in a short-duration rotational acceleration of crankshaft 30. It is evident from FIG. 2 that these rotational accelerations and the maximum and minimum speeds vary from cylinder 12 to cylinder 12, but also from working cycle to working cycle (denoted in FIG. 2 by reference numerals 40*a* and 40*b*). For example, one can see that the acceleration, which is indicated by ascending dot-dash line 42*c* in FIG. 2, is less for cylinder 12*c* than corresponding acceleration 42*d* for cylinder 12*d*. At the same time, acceleration 42*d* is less for cylinder 12*d* in working cycle 40*a* than for the same cylinder 12*d* in working cycle 40*b*. The variation of the rotational acceleration from one cylinder 12 to another cylinder 12 is known as "difference"; the variation of the rotational acceleration of the same cylinder 12 from one working cycle 40 to another is known as "fluctuation."

Internal combustion engine 10 shown in FIG. 1 may be operated in different operating states. A first operating state includes a "conventional" operating mode in which a comparatively low exhaust-gas recirculation rate of not more than 30% is used. Another operating state includes a "non-conventional" operating mode in which a comparatively high exhaust-gas recirculation rate of usually more than 35% exists. Such a high exhaust-gas recirculation rate leads to a "partial homogeneous" operation in which a comparatively strong intermixture and homogenization of the cylinder charge exists, with a comparatively high ignition lag (the ignition lag is the time which elapses from the injection of the fuel up to its ignition).

In the conventional operating mode, differences in speed or torque between individual cylinders 12 stem primarily from differences in the injection mass. In turn, they result primarily due to tolerances of individual injectors 20. However, the influence of fluctuations of the "combustion position" on the cylinder-specific torque may be disregarded in the conventional operating mode. Combustion position is understood to be that crank angle at which a specific portion, usually 50%, of the total heat is converted during the fuel combustion.

Therefore, a customary "quantity-compensation control" may be used in the conventional operating mode of internal combustion engine 10. Using such a control, the injected fuel masses are adapted for each injector 20*a* through 20*d* in such a way that the most uniform speed characteristic or torque characteristic possible is achieved. To that end, suitable fuel-correction quantities are determined and used for each injector 20*a* through 20*d*. This "learning process" is a function of the operating point and takes place continuously, so that changes which appear during the lifetime of internal combustion engine 10 are able to be offset, as well. At the same time, in addition to changes at injectors 20*a* through *d*, changes may also occur in cylinders 12*a* through *d*, e.g., in the form of different leakages and losses due to friction.

In the non-conventional operating mode, differences of speed or rotational acceleration or torque between individual cylinders 12*a* through *d* and fluctuations from one working cycle to a following working cycle do not result solely from the injection-mass differences. In this operating mode, it is no longer possible to directly draw a conclusion regarding differences in the injected fuel masses on the basis of different torque shares. However, it may be assumed that any injector shortages are independent of the operating mode. Therefore, the fuel-correction quantities determined in the conventional operating mode are used unchanged in this operating mode.

Instead, in the non-conventional operating mode, differences and fluctuations of the rotational acceleration or speed remaining after correction of the fuel quantities are attributable essentially to differences or fluctuations of the combustion position. In turn, the combustion position is primarily a function of the instant (usually expressed by a crank angle) of a fuel injection and the volume of fresh air fed via intake manifold 18 and intake valves 16*a* through *d* and the exhaust-gas recirculation rate. Therefore, by adapting these performance quantities, a reducing influence on differences and fluctuations of the rotational acceleration of crankshaft 30 may be assumed in the non-conventional operating mode.

Figure 3:
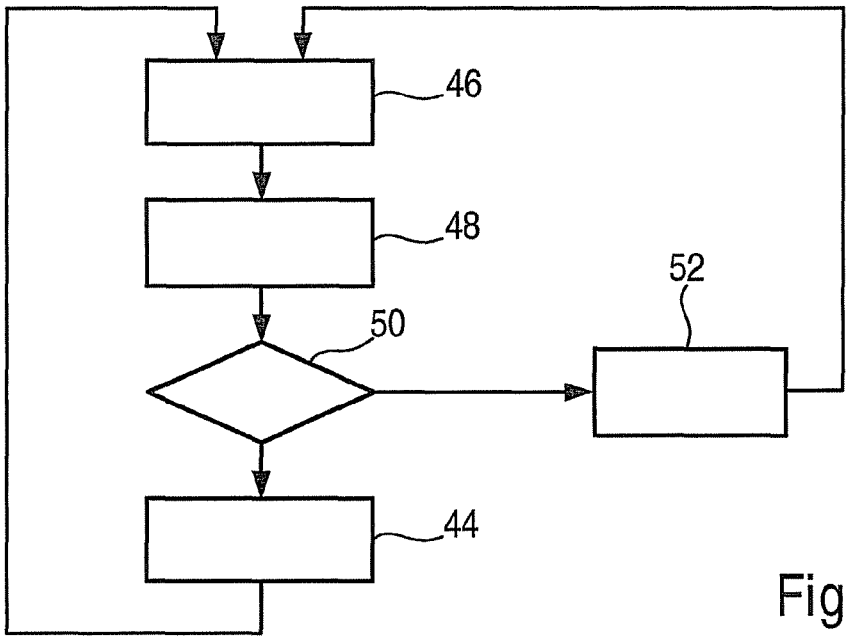
FIG. 3 shows a block diagram to clarify a method for operating the internal combustion engine from FIG. 1.

A general method for operating internal combustion engine 10 from FIG. 1 is shown in FIG. 3: Accordingly, in block 44, in the conventional operating mode, initially the fuel-correction quantities are adapted along the lines of a quantity-compensation control, so that as uniform a characteristic of the speed signal as possible is obtained in this operating mode. In 46, these correction values are used, and in the following block 48, the share of torque is ascertained for each individual cylinder 12*a* through *d* for each working cycle, e.g., based on the ascertained cylinder-specific and working-cycle-specific rotational acceleration of crankshaft 30. In 50, it is checked whether the conventional operating mode will continue to be used, or whether there is to be a change to the non-conventional operating mode, thus, e.g., a partial homogeneous combustion process. If there is a change to the non-conventional operating mode, in 52 a desired uniformity of the speed signal is brought about by the cylinder-specific adaptation of the instant of the fuel injection, the volume of fresh air supplied or the exhaust-gas recirculation rate, thus ultimately by an at least indirect regulation of the combustion position. The corresponding correction values are then used again in 46, and so forth.

Figure 4:
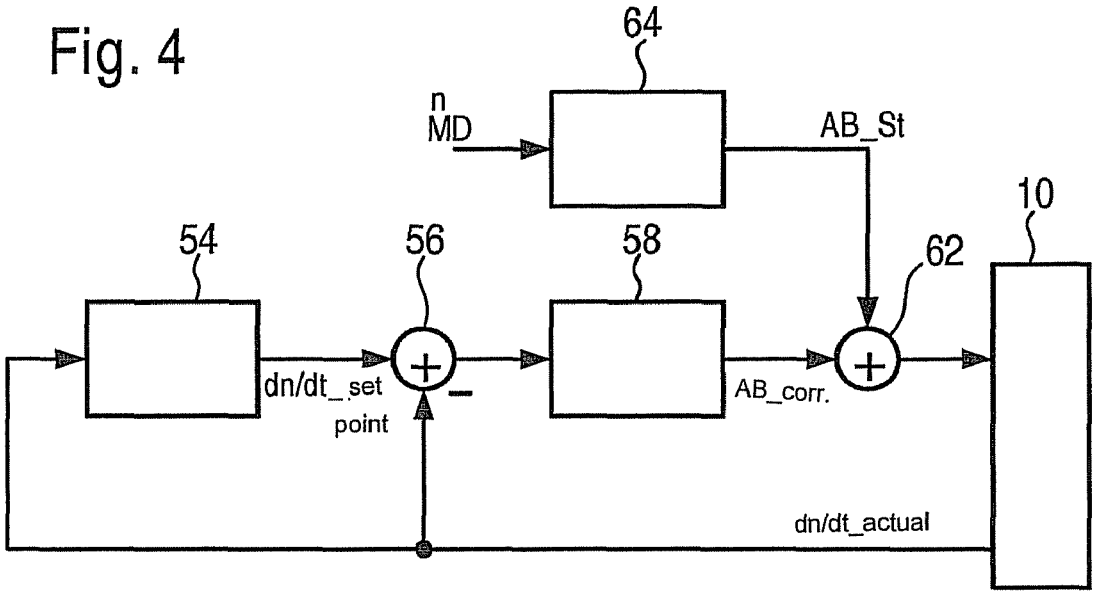
FIG. 4 shows a further block diagram to clarify a method for operating the internal combustion engine from FIG. 1.

A very simple method for regulating the combustion position is yielded from FIG. 4: In this method, the combustion position is not ascertained directly at all. Instead, a measured, cylinder-specific rotational acceleration dn/dt_actual is fed to an averager 54 which forms a temporal and local average value. This is set equal to the desired rotational acceleration, thus to setpoint value dn/dt_setpoint In 56, the difference is formed between this setpoint value dn/dt_setpoint and the cylinder-specific actual value dn/dt_actual, and it is supplied to a controller 58. From this is yielded a correction value AB_corr as manipulated variable, which in 62, is added to a control start AB_St for respective injector 20*a* through *d*. Control start AB_St is ascertained in 64 on the basis of the instantaneous operating point, for example, instantaneous speed n and instantaneous torque MD. The method shown in FIG. 4 corresponds basically to the principle of a "compensation control," for ultimately the combustion position of all cylinders 12*a* through *d* is equalized by this method. This is based on the consideration that the deviation of actual rotational acceleration dn/dt_actual from setpoint rotational acceleration dn/dt_setpoint is equal to the deviation of the cylinder-specific combustion positions from an average value.

However, it is also possible to ascertain an absolute combustion position. To that end, a reference torque is used as reference point, as explained in the following with reference to FIG. 5. This reference torque may be an applied value for the specific operating point, if it may be assumed that the sum of the cylinder-specific deviations from the setpoint torque is equal to zero, thus the actual global engine torque conforms with the setpoint torque. However, the absolute "global" engine torque may also be calculated, for example, based on the signal of combustion-chamber pressure sensor 36 by calculating the indicated torque from the measured pressure, or based on the crankshaft rotational speed and rotational acceleration detected by crankshaft sensor 32, or on the basis of the signal of lambda sensor 37 and of HFM sensor 34 and inverse calculation of the fuel mass actually injected by injectors 20*a* through *d*.

Figure 5:
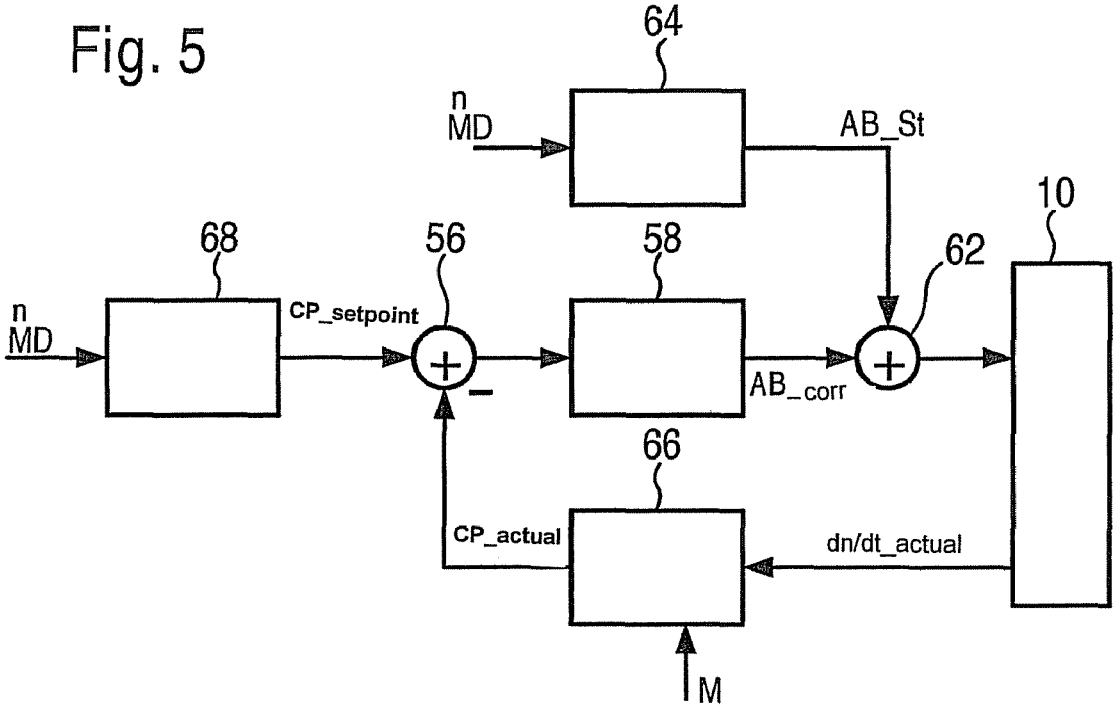
FIG. 5 shows another block diagram to clarify a method for operating the internal combustion engine from FIG. 1.

According to the example method shown in FIG. 5, the signal of crankshaft sensor 32, thus, for example, rotational acceleration dn/dt_actual, is fed to an actual-value calculation block 66 which ascertains an explicit actual combustion position CP_actual, using torque M ascertained in the manner just described. In 68, a setpoint combustion position CP_setpoint is ascertained on the basis of speed n and instantaneous load (torque) MD. In 56 (here and hereinafter, areas functionally equivalent to FIG. 4 are provided with the same reference numerals), the difference is formed between actual combustion position CP_actual and setpoint combustion position CP_setpoint and fed to controller 58, which outputs a correction value AB_corr.

Instead of the explicit determination of combustion position CP in blocks 66 and 68, it is also conceivable to determine an actual torque and a setpoint torque, and to process the corresponding difference in controller 58 to form correction value AB_corr.

The closed-loop control of the combustion position in the non-conventional operating mode presented above and the quantity-compensation control in the conventional operating mode may be coupled with an absolute control of the torque, which pre-determines a setpoint torque of the overall internal combustion engine 10 for the specific operating point, determines the actual torque and supplies the difference to a controller. For example, the controller could compensate for the difference by altering the fuel quantity, the fresh-air mass, the exhaust-gas mass, a charge-air pressure, etc.

From the description above, it becomes clear that it is especially advantageous that the correction quantities learned in the conventional operating mode in the course of the quantity-compensation control may be transferred to the other non-conventional operating mode in each instance.

What is claimed is:

1. A method for operating an internal combustion engine, comprising:

ascertaining at least one rotation variable characterizing a rotational movement of a crankshaft cylinder-specifically; and adapting, in an operating state in which at least one of differences and fluctuations of the rotation variable are a function of a combustion position, at least one of i) an instant of a fuel injection, ii) a fresh-air volume, and iii) an exhaust-gas recirculation rate to reduce the at least one of the differences and fluctuations, wherein, in an initial operating state in which the at least one of the differences and fluctuations of the rotation variable are not a function of the combustion position, an injected fuel quantity is adapted cylinder-specifically to reduce the at least one of the differences and fluctuations.

2. The method as recited in claim 1, wherein the operating state includes a non-conventional operating mode, at least one of i) the operating mode having partial homogeneous mixture formation, and ii) the operating mode being a regeneration operating mode for an exhaust-gas treatment device.

3. The method as recited in claim 1, wherein based on the cylinder-specific rotation variable, a cylinder-specific combustion position or a cylinder-specific torque is ascertained as absolute value.

4. The method as recited in claim 3, wherein a torque derived from a cylinder pressure in a guide cylinder, a torque ascertained from a lambda value and an air charge, or a torque ascertained from the rotation variable is used as a reference quantity for the absolute value.

5. The method as recited in claim 4, wherein the cylinder-specific combustion position or the cylinder-specific torque is corrected to a setpoint value.

6. The method as recited in claim 5, wherein the combustion position is adjusted to at least one of a temporal and a local average value.

7. The method as recited in claim 6, wherein in order to adjust the combustion position, the difference between a cylinder-specific actual rotation variable and an actual rotation variable averaged over the cylinders is supplied directly to a controller.

8. A storage medium storing a computer program, the computer program, when executed by a control device, causing the device to perform the steps of:

ascertaining at least one rotation variable characterizing a rotational movement of a crankshaft cylinder-specifically; and adapting, in an operating state in which at least one of differences and fluctuations of the rotation variable are a function of a combustion position, at least one of i) an instant of a fuel injection, ii) a fresh-air volume, and iii) an exhaust-gas recirculation rate to reduce the at least one of the differences and fluctuations, wherein, in an initial operating state in which the at least one of the differences and fluctuations of the rotation variable are not a function of the combustion position, an injected fuel quantity is adapted cylinder-specifically to reduce the at least one of the differences and fluctuations.

9. A control device for an internal combustion engine, the control device adapted to perform the steps of:

ascertaining at least one rotation variable characterizing a rotational movement of a crankshaft cylinder-specifically; and adapting, in an operating state in which at least one of differences and fluctuations of the rotation variable are a function of a combustion position, at least one of i) an instant of a fuel injection, ii) a fresh-air volume, and iii) an exhaust-gas recirculation rate to reduce the at least one of the differences and fluctuations, wherein, in an initial operating state in which the at least one of the differences and fluctuations of the rotation variable are not a function of the combustion position, an injected fuel quantity is adapted cylinder-specifically to reduce the at least one of the differences and fluctuations.

* * * * *